US009376896B2

(12) United States Patent
Smith

(10) Patent No.: US 9,376,896 B2
(45) Date of Patent: Jun. 28, 2016

(54) BOTTOMHOLE ASSEMBLY FOR CAPILLARY INJECTION SYSTEM AND METHOD

(71) Applicant: Weatherford Technology Holdings, LLC, Houston, TX (US)

(72) Inventor: Roddie R. Smith, Dyce (GB)

(73) Assignee: Weatherford Technology Holdings, LLC, Houston, TX (US)

( * ) Notice: Subject to any disclaimer, the term of this patent is extended or adjusted under 35 U.S.C. 154(b) by 351 days.

(21) Appl. No.: 13/774,821

(22) Filed: Feb. 22, 2013

(65) Prior Publication Data

US 2013/0233557 A1 Sep. 12, 2013

Related U.S. Application Data

(60) Provisional application No. 61/607,835, filed on Mar. 7, 2012.

(51) Int. Cl.

| | |
|---|---|
| ***E21B 43/16*** | (2006.01) |
| ***E21B 33/047*** | (2006.01) |
| ***E21B 34/10*** | (2006.01) |
| ***E21B 43/12*** | (2006.01) |
| ***E21B 43/25*** | (2006.01) |
| ***E21B 34/06*** | (2006.01) |

(52) U.S. Cl.

CPC ..... *E21B 43/16* (2013.01); *E21B 33/047* (2013.01); *E21B 34/06* (2013.01); *E21B 34/10* (2013.01); *E21B 43/12* (2013.01); *E21B 43/25* (2013.01)

(58) Field of Classification Search

USPC ..... 166/305.1, 319, 320, 321, 325, 326

See application file for complete search history.

(56) References Cited

U.S. PATENT DOCUMENTS

| | | | | |
|---|---|---|---|---|
| 3,366,074 | A | 1/1968 | Shirley | |
| 5,979,553 | A * | 11/1999 | Brink | 166/250.08 |
| 6,880,639 | B2 | 4/2005 | Rhodes et al. | |
| 7,708,075 | B2 | 5/2010 | Lake et al. | |
| 7,823,648 | B2 | 11/2010 | Bolding et al. | |
| 7,861,786 | B2 | 1/2011 | Hill, Jr. et al. | |
| 7,861,788 | B2 * | 1/2011 | Tips et al. | 166/319 |
| 7,963,334 | B2 * | 6/2011 | Hill et al. | 166/322 |
| 2004/0040718 | A1 | 3/2004 | Rhodes et al. | |
| 2004/0253734 | A1 | 12/2004 | Firmin | |
| 2006/0213715 | A1 * | 9/2006 | Krieger | B62D 5/061 180/408 |
| 2009/0277643 | A1 | 11/2009 | Mondelli et al. | |

FOREIGN PATENT DOCUMENTS

| | | |
|---|---|---|
| EP | 2105578 A1 | 9/2009 |

OTHER PUBLICATIONS

EPO Extended Search Report and Written Opinion dated Apr. 15, 2013, European Patent Application No. 13157019.4.

Bert Lugtmeier et al.—"A new way to revive old gas wells," Offshore Engineer, Nov. 2011, pp. 57, 58 and 60.

(Continued)

*Primary Examiner* — Sean Andrish

(74) *Attorney, Agent, or Firm* — Patterson & Sheridan, LLP

(57) ABSTRACT

A method of treating production fluid in a wellbore includes deploying a capillary string into the wellbore. The capillary string has a plurality of injection valves. The method further includes pumping treatment fluid through the capillary string and into the wellbore. The injection valves have a cumulative set pressure greater than or equal to a hydrostatic pressure of the treatment fluid.

9 Claims, 4 Drawing Sheets

(56) References Cited

OTHER PUBLICATIONS

Weatherford International Ltd.—Weatherford Capillary Technologies brochure, © 2003-2009, 4 pages.

Canadian Office Action dated Jan. 14, 2014, for Canadian Patent Application No. 2,807,016.

Austrailian Exam Report for Patent Application No. 2013201288, dated Jul. 7, 2014.

* cited by examiner

2/4

BOTTOMHOLE ASSEMBLY FOR CAPILLARY INJECTION SYSTEM AND METHOD

BACKGROUND OF THE INVENTION

1. Field of the Invention

Embodiments of the present invention generally relate to a bottomhole assembly for a capillary injection system.

2. Description of the Related Art

Wells, particularly those wells which produce hydrocarbons, exhibit various conditions which affect well production or the operability of the equipment inserted into the well. One way of treating such conditions is to inject predetermined amounts of treatment fluid into the well at a downhole location. Such treatment fluid can be pumped from the surface through a capillary tube to a downhole injection valve. If a full column of treatment fluid can be maintained in the capillary tube leading from the pump to the bottom of the well, control of the amount of treatment fluid injected into the well is a relatively simple operation.

However, it has long been recognized by well operators that if the injection pressure or back-pressure exerted on the valve at the bottom of the capillary tube is not correct, the contents of the capillary tube may actually be siphoned into the well. This siphoning action of the treatment fluid within the capillary tube is due to the fact that the hydrostatic pressure at the end of the capillary tube is greater than the bottomhole pressure within the well. Therefore, the capillary tube sees a relative vacuum. This relative vacuum results in the siphoning of the treatment fluid out of the capillary tube and into the well. This unwanted siphoning of treatment fluid from the capillary tube makes it very difficult to regulate or assure a consistent flow or continuous volume of chemical into the well.

In addition, the siphoning or vacuum of treatment fluid within the capillary tube causes the fluid to boil, thus depositing buildup in the tube which can lead to blockage. The movement of gases and fluids through the capillary tube caused by voids or bubbles also results in an inconsistent application of treatment fluid. In such situations, it has been found that much more treatment fluid must be used than what appears to be actually needed to control a condition within the well.

SUMMARY OF THE INVENTION

Embodiments of the present invention generally relate to a bottomhole assembly for a capillary injection system. In one embodiment, a method of treating production fluid in a wellbore includes deploying a capillary string into the wellbore. The capillary string has a plurality of injection valves. The method further includes pumping treatment fluid through the capillary string and into the wellbore. The injection valves have a cumulative set pressure greater than or equal to a hydrostatic pressure of the treatment fluid.

In another embodiment, a bottom hole assembly for deployment into a wellbore includes a plurality of injection valves connected in series. Each injection valve includes: a tubular housing have a valve seat; a valve member; and a biasing member pushing the valve member toward engagement with the valve seat. The biasing member is preloaded such that a set pressure of each valve is greater than or equal to 1 ksi.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1A:
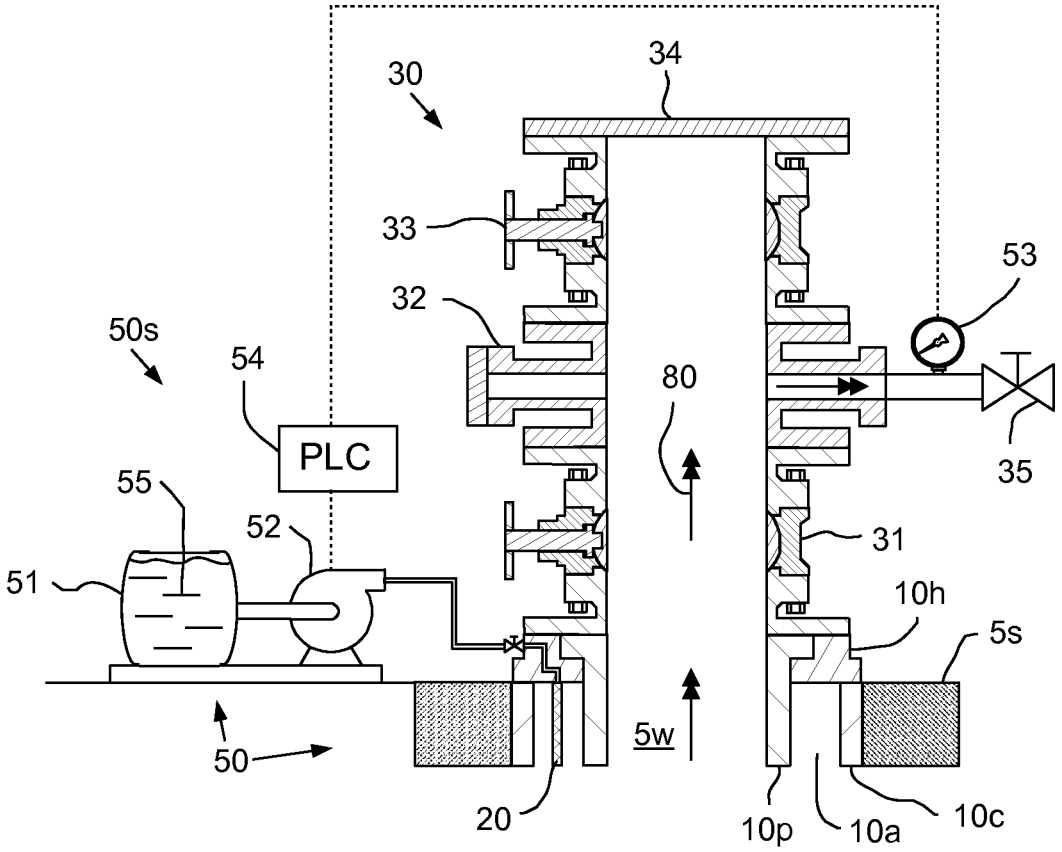
FIGS. 1A-C illustrate operation of a capillary injection system, according to one embodiment of the present invention.
Figure 1B:
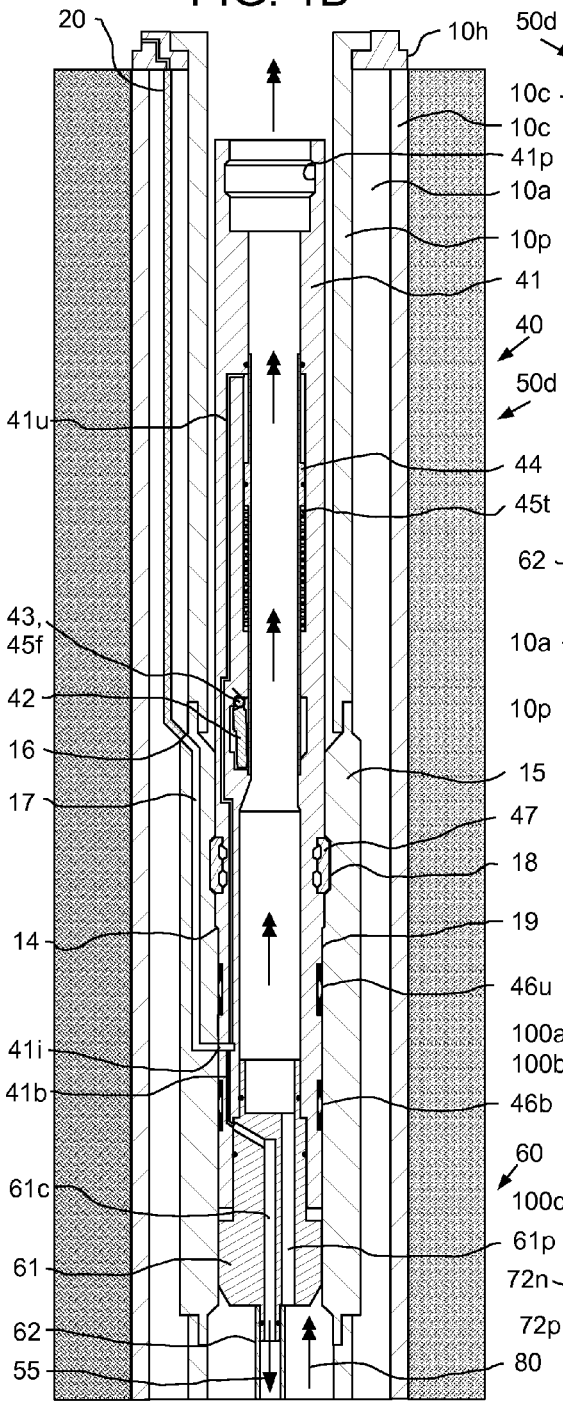
Figure 1C:
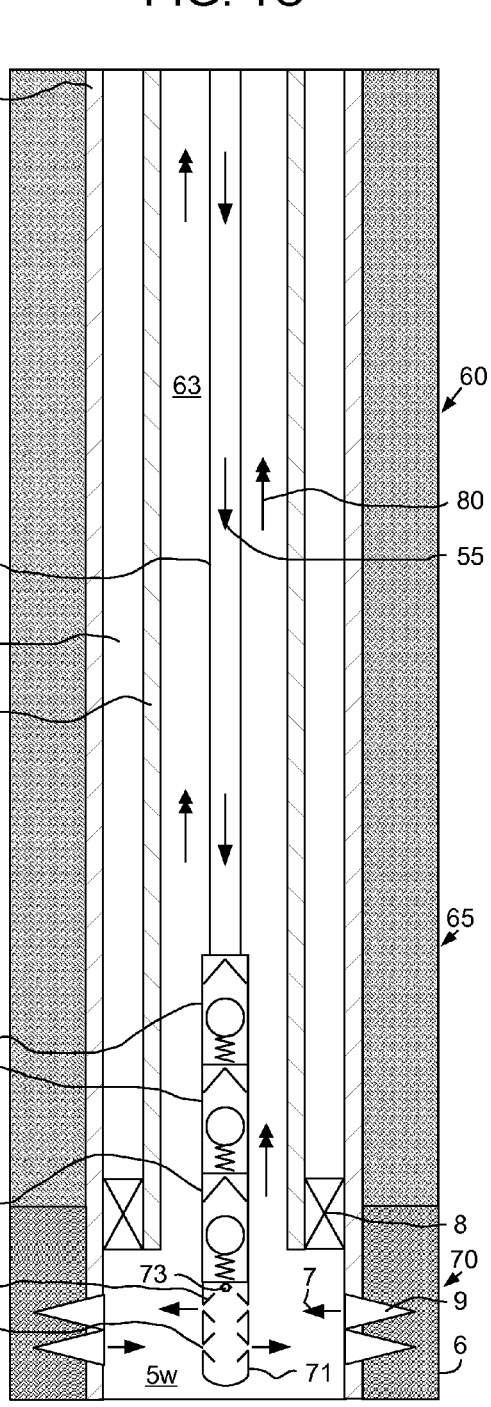

FIGS. 1A-C illustrate operation of a capillary injection system 50, according to one embodiment of the present invention. A wellbore 5*w* has been drilled from a surface 5*s* of the earth into a hydrocarbon-bearing (i.e., natural gas) reservoir 6. A string of casing 10*c* has been run into the wellbore 5*w* and set therein with cement (not shown). The casing 10*c* has been perforated 9 to provide fluid communication between the reservoir 6 and a bore of the casing 10*c*. The casing may extend from a wellhead 10*h* located at the surface 5*s*. A string of production tubing 10*p* is supported and extends from the wellhead 10*h* to the reservoir 6 to transport production fluid 7 from the reservoir 6 to the surface 5*s*. A packer 8 has been set between the production tubing 10*p* and the casing 10*c* to isolate an annulus 10*a* formed between the production tubing and the casing from production fluid 7.

Alternatively, the wellbore may be subsea and the wellhead may be located at the seafloor or at a surface of the sea.

A production (aka Christmas) tree 30 has been installed on the wellhead 10*h*. The production tree 30 may include a master valve 31, flow cross 32, a swab valve 33, a cap 34, and a production choke 35. Production fluid 7 from the reservoir 6 may enter a bore of the production tubing 10*p*, travel through the tubing bore to the surface 5*s*. The production fluid 7 may continue through the master valve 31, the tee 32, and through the choke 35 to a flow line (not shown). The production fluid 7 may continue through the flow line to a separation, treatment, and storage facility (not shown). The reservoir 6 may initially be naturally producing and may deplete over time to require an artificial lift system, such as the capillary injection system 50, to maintain production. Typically, depletion of the natural gas reservoir 6 is characterized by inadequate pore pressure to lift incidental liquid, such as brine, also present in the reservoir, to the surface 5*s*. This depletion is also known as liquid loading.

The capillary injection system 50 may include an injection unit 50*s* located at the surface 5*s*, a landing nipple 15, a control line 20, and a downhole assembly 50*d*. The injection unit 50*s* may include a tank 51 of treatment fluid 55, an injection pump 52, one or more feedback sensors 53, and a programmable logic controller (PLC) 54. The injection pump 52 may intake the treatment fluid 55 from the tank 51 and discharge the treatment fluid into the control line 20 via the wellhead 10*h*. The injection pump 52 may be driven by an electric motor (not separately shown). The PLC 54 may be in data communication with a controller (not shown) of the pump motor and may control a flow rate of the injection pump 52 by varying a speed of the motor. The feedback sensors 53 may be in fluid communication with a mixture 80 of the production fluid 7 and treatment fluid 55. The sensors 53 may include a pressure (or pressure and temperature) sensor, one or more single phase flow meters, or a multiphase flow meter. The PLC 54 may be in data communication with the sensors and use the feedback from the sensors to control the pump flow rate for optimizing a production flow rate.

The treatment fluid 55 may be a liquid, such as a foamer. Alternatively or additionally, the treatment fluid may be/include a corrosion inhibitor, scale inhibitor, salt inhibitor, paraffin inhibitor, hydrogen sulfide inhibitor, and/or carbon dioxide inhibitor.

The downhole assembly 50*d* may include a subsurface safety valve (SSV) 40 and a capillary string 60. In anticipation of the reservoir depletion, the production tubing string 10*p* may have been installed with a landing nipple 15 assembled as a part thereof and the control line 20 secured therealong. The landing nipple 15 may be located in the wellbore 5*w* adjacent the wellhead 10*h*. If not previously installed, an upper portion of the production tubing 10*p* may be disassembled, reconfigured by adding the landing nipple 15, and the reconfigured production tubing reassembled during a workover operation.

The nipple 15 may receive a lower end of the control line 20, the SSV 40, and a hanger 61 of the capillary string 60. The nipple 15 may be a tubular member having threaded couplings formed at each longitudinal end thereof for connection as part of the production tubing 10*p*. The nipple 15 may have a landing shoulder 14 formed in an inner surface thereof, a penetrator 16 formed in an outer surface thereof, a flow passage for 17 formed in and along a wall thereof, a latch profile, such as a groove 18, formed in an inner surface thereof, and a polished bore receptacle (PBR) 19 formed in an inner surface thereof. The lower end of the control line 20 may connect to the penetrator 16 and the penetrator may provide fluid communication between the flow passage 17 and the control line 20. The landing shoulder 14 may receive a corresponding shoulder of the SSV 40 for supporting the capillary string 60 from the production tubing 10*p*. The PBR 19 may receive a straddle seal pair 46*u,b* of the SSV 40 and provide fluid communication between the flow passage 17 and an inlet 41*i* of the SSV 40. The latch groove 18 may receive a latch 47 of the SSV 40 and longitudinally connect the SSV to the production tubing 10*p*.

Figure 3A:
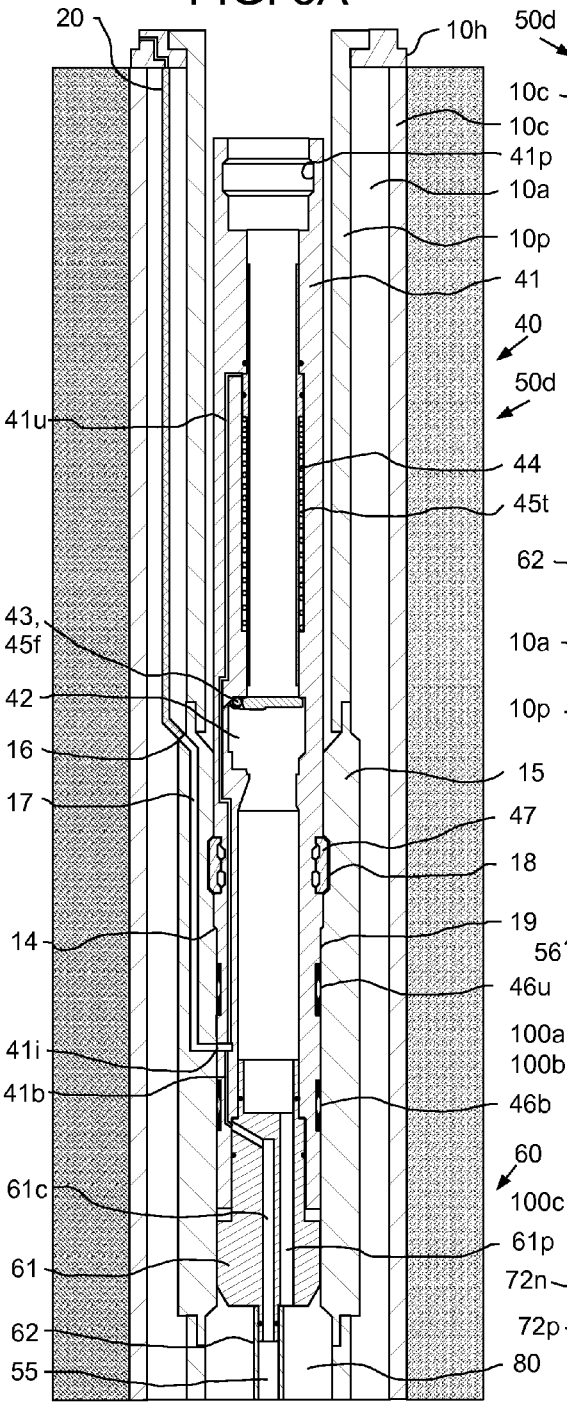
FIGS. 3A and 3B illustrate operation of injection valves of the capillary injection system.

The SSV 40 may include a tubular housing 41, a valve member, such as a flapper 42, and an actuator. The flapper 42 may be operable between an open position (FIG. 1B) and a closed position (FIG. 3A). The flapper 42 may be pivoted to the housing by a fastener 43. The flapper 42 may allow flow through the housing/production tubing bore in the open position and seal the housing/production tubing bore in the closed position. The flapper 42 may operate as a check valve in the closed position i.e., preventing flow from the reservoir 6 to the wellhead 10*h* but allowing flow from the wellhead to the reservoir. Alternatively, the SSV 40 may be bidirectional. The actuator may include a flow tube 44 and one or more biasing members, such as a flow tube spring 45*t* and a flapper spring 45*f*. The flow tube 44 may be longitudinally movable relative to the housing 41 between an upper position and a lower position. The flow tube 44 may be operable to engage the flapper 42 and force the flapper to the open position when moving from the upper position to the lower position. The flow tube 44 may be clear from the flapper 42 in the upper position. The flow tube 44 may also protect the flapper 42 in the open position.

The housing 41 may have the inlet 41*i*, a chamber formed in an inner surface thereof, and one or more flow passages in and along a wall thereof, such as an upper flow passage 41*u* and a lower flow passage 41*b*. The flow tube 44 may also have a piston formed in an outer surface thereof and disposed in the housing chamber. The flow tube piston may partition the housing chamber into an upper hydraulic chamber and a lower spring chamber. The upper flow passage 41*u* may provide fluid communication between the housing inlet 41*i* and the hydraulic chamber. The flow tube spring 45*t* may be disposed in the spring chamber and against the flow tube piston and may be operable to bias the flow tube 44 toward the upper position. The flapper spring 45*f* may be disposed around the pivot fastener 43 and against the flapper and may be operable to bias the flapper toward the closed position. During operation of the capillary injection system 50, back pressure resulting from injection of treatment fluid 55 through the control line 20 and the capillary string 60 may move the flow tube 44 downward against the flow tube spring, thereby opening the flapper 42.

The housing 41 may further have a fishing profile 41*p* formed in an inner surface thereof for engagement with a latch of a setting tool (not shown). The SSV 40 may further include the straddle seal pair 46*u,b*. Each straddle seal 46*u,b* may be a seal stack and may be disposed in respective grooves formed in an outer surface of the housing 41 such that the pair straddle the housing inlet 41*i*. The SSV 40 may further include the latch 47 (only schematically shown). The latch 47 may include one or more fasteners, such as dogs, and an actuator. The dogs may be radially movable relative to the housing between an extended position and a retracted position. The actuator may include a locking sleeve having a locked position and an unlocked position. The locking sleeve may be operable to extend and restrain the dogs in the extended position when moving from the unlocked position to the locked position. The locking sleeve may be operated between the positions by interaction with the setting tool.

The capillary string 60 may include the hanger 61, a tubular string, such as a coiled tubing string 62, and a bottomhole assembly (BHA) 65. A nominal diameter of the coiled tubing 62 and a nominal diameter of the BHA 65 may be substantially less than a nominal diameter of the production tubing 10*p*, such as less than or equal to one-fifth the production tubing nominal diameter. The hanger 61 may have threaded couplings formed at each longitudinal end thereof for connection to the SSV housing 41 at the upper end and to an upper end of the coiled tubing 62 at the lower end. The hanger-coiled tubing connection may also be sealed, such as by an o-ring. The hanger 61 may have a crossover passage 61*c* providing fluid communication between the lower SSV housing passage 41*b* and a bore of the coiled tubing 62. An annulus 63 may be formed between the production tubing 10*p* and the coiled tubing 62. The hanger 61 may also have one or more (one shown) production fluid passages 61*p* providing fluid communication between the annulus 63 and a bore of the SSV housing 41. The interface between the crossover passage 61*c* and the lower SSV housing passage 41*b* may be straddled by a pair of seals, such as o-rings.

Alternatively, the capillary string may extend to the surface and be hung from the wellhead or the tree. In this alternative, the SSV may be omitted, may be independent of the capillary injection system and locked open, or may include a bypass passage for the capillary string. Alternatively, the SSV may be deployed and retrieved independently of the capillary string.

The BHA 65 may include a plurality of injection valves 100*a-c* connected in series and an injection shoe 70. The injection valves 100*a-c* may be directly connected to one another. Alternatively, the BHA may include intermediary members disposed between the injection valves, such as spacers. Alternatively, the BHA may only include the lower injection valve 100*c* and the upper 100*a* and mid 100*b* injection valves may be located along the coiled tubing string 62.

A length of the capillary coiled tubing 62 may correspond to a length of the production tubing 10*p* below the nipple 15 so that the injection shoe 70 is located adjacent the perforations 9. The injection shoe 70 may include a tubular body 71 having a tubular portion and a nose portion. A bore may be formed through the tubular portion. The nose portion may be curved (aka bull nose) to guide the BHA 65 through the production tubing 10*p* during deployment of the downhole assembly 50*d*. The bore may or may not extend through the nose portion. Injection ports 72*p* may also be formed through a wall of the tubular portion and may provide fluid communication between the shoe body bore and a bottom of the annulus 63 (aka bottomhole).

The injection shoe 70 may further include nozzles 72*n*, each connected to the body 71 and lining a respective port 72*p*. The nozzles 72*n* may be made from an erosion resistant material, such as tool steel, cermet, ceramic, or corrosion resistant alloy. The injection shoe 70 may further include a check valve 73 oriented to allow flow of the treatment fluid 55 from the coiled tubing 62, through the injection valves 100*a-c* and the injection ports 72*n,p* and into the bottom of the annulus 63 and to prevent reverse flow therethrough. The check valve 73 may be spring-less or have a minimal stiffness spring set to an insignificant pressure, such as less than or equal to fifty pounds per square inch (psi) or corresponding to a weight of the check valve member. The check valve 73 may be operable to prevent fouling of the lower injection valve 100*c* by particle laden production fluid 7 during deployment of the downhole assembly 50*d*.

A deployment string may be used to deploy and retrieve the downhole assembly 50*d* into/from the wellbore. The deployment string may include the setting tool and a conveyor, such as wire rope, connected to an upper end of the setting tool. Alternatively, the conveyor may be wireline, slickline, or coiled tubing. To deploy the downhole assembly 50*d*, a lower end of the setting tool may be connected to the fishing profile 41*p*. The reservoir 6 may be killed using kill fluid or a lubricator (not shown) and coiled tubing injector (not shown) may be used to insert the downhole assembly 50*d* and setting tool into the live wellhead. The downhole assembly 50*d* may be lowered into the wellbore 5*w* until the SSV 40 lands onto the shoulder 14. The conveyor may then be articulated to set the latch 47 and the deployment string may then be retrieved to the surface 5*s*.

Figure 2A:
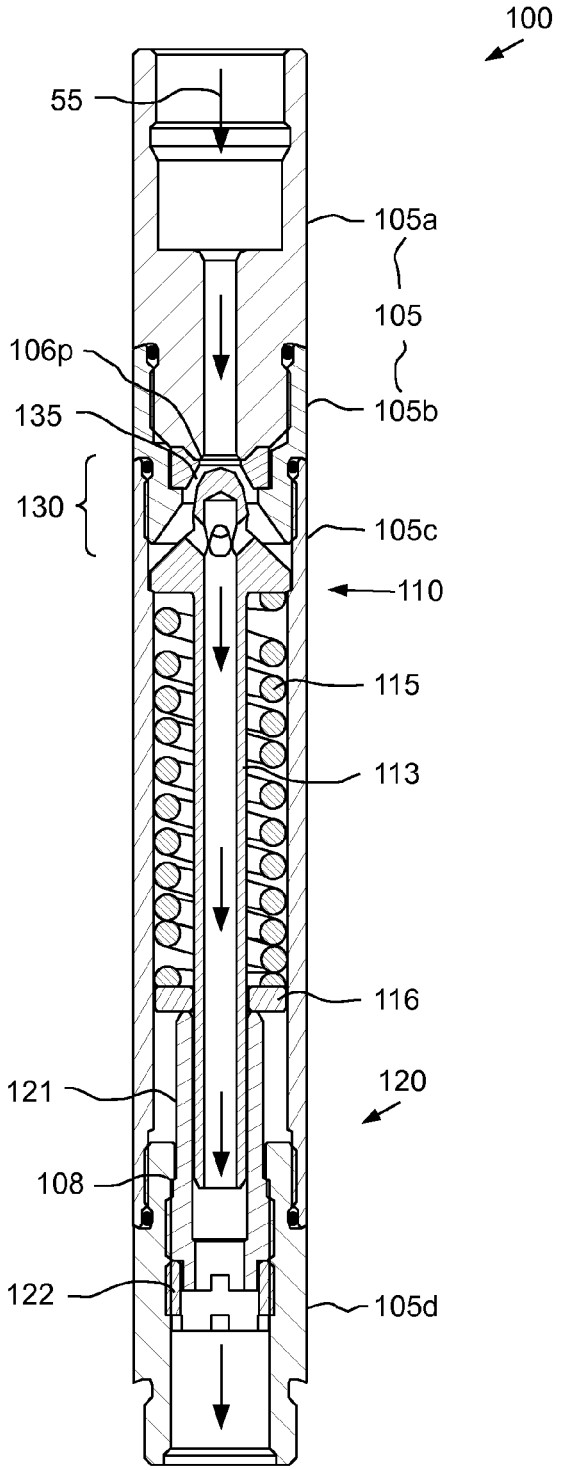
FIG. 2A illustrates one of the injection valves in an open position.
Figure 2B:
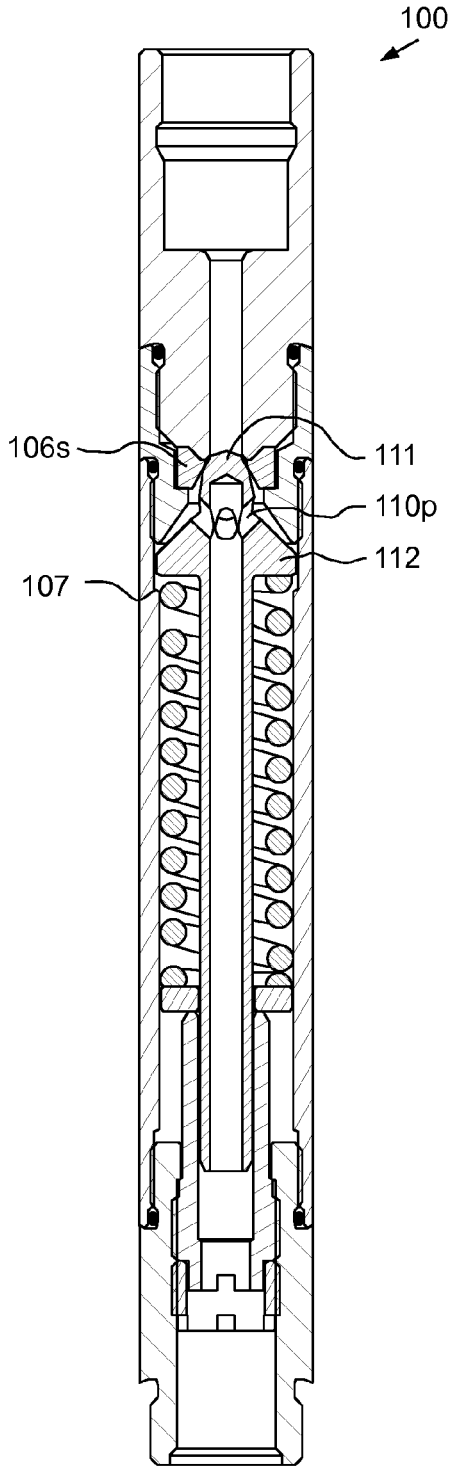
FIG. 2B illustrates one of the injection valves in a closed position.

FIG. 2A illustrates one 100 of the injection valves 100*a-c* in an open position. FIG. 2B illustrates one 100 of the injection valves 100*a-c* in a closed position. Each injection valve 100 may include a housing 105, one or more seats, such as a primary seat 106*p* and a secondary seat 106*s*, a poppet 110, a biasing member, such as a spring 115, and an adjuster 120. The housing 105 may be tubular, have a bore formed therethrough, and have threaded couplings formed at each longitudinal end thereof for connection with the shoe 70, a lower end of the coiled tubing 62, and/or another one of the isolation valves 100*a-c*. To facilitate manufacture and assembly, the housing 105 may include two or more sections 105*a-d* connected together, such as by threaded couplings, and sealed, such as by o-rings.

The primary seat 106*p* may be formed in a lower portion of the first housing section 105*a*. Each of the poppet 110 and the primary seat 106*p*/first housing section 105*a* may be made from one of the erosion resistant materials, discussed above. The secondary seat 106*s* may be longitudinally connected to the housing 105, such as by entrapment between two of the housing sections 105*a,b*. Each of the secondary seat 106*s* and the second housing section 105*b* may have a conical inner surface.

The poppet 110 may be longitudinally movable relative to the housing 105 between an open position and a closed position. The poppet 110 may have a head portion 111, a skirt portion 112, and a stem portion 113. The poppet 110 may have a bore formed through the skirt 112 and stem 113 portions and one or more ports 110*p* formed through the head 111 and skirt 112 portions at an interface between the two portions. An outer surface of the head portion 111 may be curved, such as spherical, spheroid, or ovoid, or a polygonal approximation of a curve. An upper face of the skirt portion 112 may be conical.

A transition region 130 may be defined between the seats 106*p,s* (and second housing section 105*b*) and the poppet 110 (head portion 111 and skirt upper face). Longitudinal downward flow of treatment fluid 55 from the first housing section 105*a* may be diverted in the transition region 130 along an outwardly inclined path and then diverted again along an inwardly inclined path into the ports 110*p*. The treatment fluid flow may then be restored to a longitudinally downward direction in the stem bore. A throat 135 may be defined in the transition region 130 between the head portion 111 and the secondary seat 106*s*.

A spring chamber may be formed between the third housing section 105*c* and the stem portion 113. The spring chamber may be vented (not shown) to the annulus 63. The spring 115 may be disposed in the spring chamber and have an upper end pressing against a lower face of the skirt portion 112 and a lower end pressing against an upper face of a spring retainer 116. A lower face of the spring retainer 116 may press against the adjuster 120.

The adjuster 120 may include a mandrel 121 and a fastener, such as a nut 122. The mandrel 121 may have a threaded head portion and a smooth shaft portion. The head portion may interact with a threaded inner surface of the fourth housing section 105*d* to adjust a longitudinal position of the spring retainer 116 for adjusting a preload of the spring 115. Once the preload of the spring 115 has been adjusted, the nut 122 may be tightened against the mandrel head to lock the mandrel 121 in place. A shoulder 108 may be formed in an inner surface of the fourth housing section 105*d* may engage a shoulder formed in an outer surface of the mandrel 121 between the head and shaft portions to define a maximum adjustment position (shown). A lower portion of the poppet stem 113 may extend into a bore of the mandrel 121. The poppet stem portion 113 may be slidable relative to the mandrel 121 and laterally restrained thereby.

The head portion 111 may be pressed into sealing engagement with the primary seat 106*p* by the preloaded spring 115 in the closed position. The sealing engagement of the head portion 111 and primary seat 106*p* may be direct. For individual operation, once the injection pump 52 is started, pressure in the first housing section 105*a* may increase until a downward fluid force is exerted on the poppet head portion 111 sufficient to overcome the upward force exerted on the poppet 110 by the spring 115. The poppet 110 may then move downward until a shoulder formed in the lower face of the skirt portion 112 engages a shoulder 107 formed in an inner surface of the third housing section 105*c*. The pressure at which fluid force exerted on the poppet head portion 111 is equal to the preloaded spring force exerted on the poppet 110 is the set (aka crack) pressure of the valve 100.

Alternatively, one or more portions 111-113 of the poppet 110 may be separate members connected to each other, such as by threaded connections.

Figure 3B:
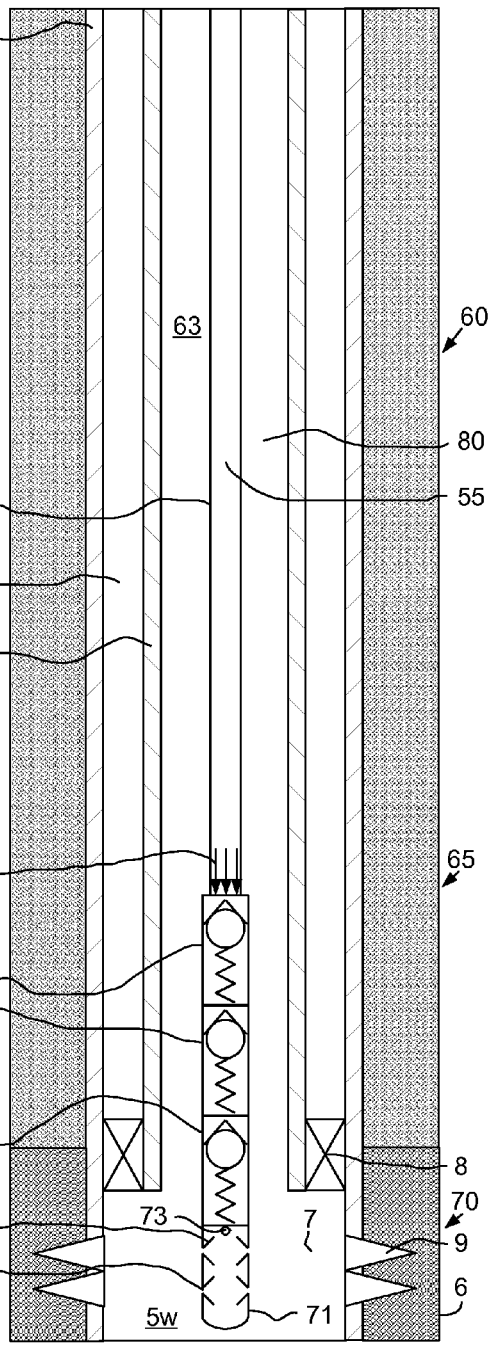

FIGS. 3A and 3B illustrate operation of the injection valves 100*a-c*. The incompressibility of the treatment fluid 55 may provide a hydraulic linkage between the plurality of injection valves 100*a-c* such that the injection valves may effectively act as a single injection valve having a cumulative set pressure equal to a sum of the individual set pressures of the valves. Should injection of the treatment fluid 55 unexpectedly be halted, i.e. by equipment failure or power outage, pressure at the top of the BHA 65 may decrease to the hydrostatic pressure 56 exerted by the column of treatment fluid 55 in the coiled tubing 62 and control line 20.

The cumulative pressure of the injection valves 100*a-c* may be greater than or equal to the hydrostatic pressure 56 such that the injection valves 100*a-c* may close in an effectively simultaneous fashion in response to the reduction in pressure even though the hydrostatic pressure 56 may be substantially greater than the set pressure of an individual injection valve. Closure of the valves 100*a-c* prevents siphoning of the treatment fluid 55 from the capillary string 60 into the wellbore 5*w*. However, during pumping of the treatment fluid 55 through the capillary string 60, pressure differential across the transition region 130 of an individual injection valve 100 corresponds to the individual set pressure instead of the cumulative set pressure, thereby reducing velocity of the treatment fluid 55 through the throat 135 of the individual valve 100 relative to a single injection valve having the cumulative set pressure. Such reduction in pressure differential may reduce deleterious effects, such as erosion and/or chattering.

The set pressure of an individual injection valve 100 may be selected according to parameters of the injection valve, such as throat area and erosion resistance of the poppet material and seat material, parameters of the treatment fluid, and an injection rate of the treatment fluid. The minimum individual set pressure may be greater than or equal to one thousand psi (one ksi), such as fifteen hundred psi. The maximum individual set pressure may be less than or equal to four thousand psi, such as thirty-five hundred psi. Alternatively or additionally, the maximum individual set pressure may be determined such that flow through the throat 135 is subsonic and/or or transonic.

The individual set pressures may be equal and the quantity of injection valves 100*a-c* for the BHA 65 may be determined by dividing the hydrostatic pressure 56 by the individual set pressure. For example, if the hydrostatic pressure is seventy-five hundred psi and the individual set pressure is twenty-five hundred psi, then the BHA 65 should have at least three injection valves 100*a-c*. An extra injection valve may be included in the BHA 65 for redundancy or the set pressure used in the calculation may be reduced by a redundancy margin. The calculation may or may not neglect hydrostatic bottomhole pressure in the wellbore 5*w*. If neglected, the hydrostatic bottomhole pressure may be relied on as the redundancy margin.

Alternatively, the individual set pressures may be different.

While the foregoing is directed to embodiments of the present invention, other and further embodiments of the invention may be devised without departing from the basic scope thereof, and the scope thereof is determined by the claims that follow.

The invention claimed is:

1. A method of treating production fluid in a wellbore, comprising:

deploying a capillary string into the wellbore, the capillary string having a plurality of injection valves; and pumping treatment fluid through the capillary string and into the wellbore, wherein:

the injection valves have a cumulative set pressure greater than or equal to a hydrostatic pressure of the treatment fluid, and an individual set pressure of each valve is greater than or equal to 1 ksi.

2. The method of claim 1, wherein the individual set pressure is less than or equal to 4 ksi.

3. The method of claim 2, wherein the individual set pressure is greater than or equal 1.5 ksi and less than or equal to 3.5 ksi.

4. The method of claim 1, wherein flow of the treatment fluid through a throat of each valve is subsonic or transonic.

5. The method of claim 1, wherein:

an individual set pressure of each valve is equal, and the capillary string has a quantity of valves greater than or equal to the hydrostatic pressure divided by the individual set pressure.

6. The method of claim 1, wherein the valves are part of a bottom hole assembly of the capillary string.

7. The method of claim 6, wherein the bottom hole assembly further has an injection shoe in fluid communication with an outlet of one of the valves and having a tubular body and one or more ports formed through a wall thereof for discharging fluid received from the outlet.

8. The method of claim 7, wherein the injection shoe further has a check valve.

9. The method of claim 1, wherein:

the capillary string is hung from a production tubing string disposed in the wellbore, and the capillary string is hung adjacent to a subsurface safety valve.

* * * * *